US011300306B2

(12) United States Patent
Zuro

(10) Patent No.: US 11,300,306 B2
(45) Date of Patent: Apr. 12, 2022

(54) PORTABLE, SELF-CONTAINED AND CONFIGURABLE MAKEUP AIR UNIT

(71) Applicant: Z Line Kitchen and Bath LLC, Reno, NV (US)

(72) Inventor: Andrew Zuro, Washoe Valley, NV (US)

(73) Assignee: Z Line Kitchen and Bath LLC, Reno, NV (US)

( * ) Notice: Subject to any disclaimer, the term of this patent is extended or adjusted under 35 U.S.C. 154(b) by 255 days.

(21) Appl. No.: 16/802,960

(22) Filed: Feb. 27, 2020

(65) Prior Publication Data

US 2020/0278124 A1 Sep. 3, 2020

Related U.S. Application Data

(60) Provisional application No. 62/811,721, filed on Feb. 28, 2019.

(51) Int. Cl.
*F24F 7/08* (2006.01)
*F24F 110/30* (2018.01)

(52) U.S. Cl.
CPC ..... *F24F 7/08* (2013.01); *F24F 2110/30* (2018.01)

(58) Field of Classification Search
CPC .... F24F 7/08; F24F 2110/30; F24F 2013/205; F24F 13/0236
USPC ..... 454/239
See application file for complete search history.

(56) References Cited

U.S. PATENT DOCUMENTS

| | | | | |
|---|---|---|---|---|
| 10,488,070 | B1 * | 11/2019 | Wolfson | F24F 11/0001 |
| 2008/0194194 | A1 * | 8/2008 | Boxhoorn | F24F 11/30 454/239 |
| 2014/0106660 | A1 * | 4/2014 | Salerno | F24F 11/77 454/239 |
| 2015/0292761 | A1 * | 10/2015 | Teoh | F24F 12/006 454/242 |
| 2016/0290675 | A1 * | 10/2016 | Hashino | F24F 11/83 |
| 2018/0202464 | A1 * | 7/2018 | Soutar | F04D 29/4226 |
| 2020/0124311 | A1 * | 4/2020 | Keogh | F24F 1/0035 |

FOREIGN PATENT DOCUMENTS

| | | | | |
|---|---|---|---|---|
| DE | 9210891 | U1 * | 12/1992 | F24F 12/001 |

* cited by examiner

*Primary Examiner* — Steven B McAllister
*Assistant Examiner* — Charles R Brawner
(74) *Attorney, Agent, or Firm* — Dickinson Wright PLLC

(57) ABSTRACT

A makeup air unit comprising a housing defining a compartment. The housing further defines at least one exhaust inlet for receiving air from an indoor space into the compartment and at least one exhaust outlet for passing air from the compartment to the atmosphere. The housing further defines at least one intake inlet and at least one intake outlet each extending into the compartment. The exhaust inlet and outlet are fluidly disconnected from the intake inlet and outlet. An air moving device overlies the intake outlet and is configured to transfer air from the compartment through the intake outlet into the work space. A flap switch unit is disposed in the compartment adjacent to the exhaust outlet and is configured to detect a flow of air through the exhaust inlet and to activate the air moving device in response to a detection of the flow of air.

17 Claims, 4 Drawing Sheets

PORTABLE, SELF-CONTAINED AND CONFIGURABLE MAKEUP AIR UNIT

CROSS-REFERENCE TO RELATED APPLICATIONS

This patent application claims priority to U.S. Provisional Patent Application Ser. No. 62/811,721, filed Feb. 28, 2019, which is incorporated herein by reference in its entirety.

TECHNICAL FIELD

The present disclosure relates generally to HVAC systems and technology. More specifically, it relates to make-up air units for circulating air and maintaining balanced air pressure in an indoor space.

BACKGROUND

An increasing number of living and indoor spaces are built with improved and very effective insulation and other construction means that minimize and in some cases eliminates air flow making some of them nearly air tight. Many new homes are so well insulated to save on heating and electrical costs, that they are essentially air tight. This has created somewhat dangerous environments in homes, offices, and other spaces. City regulators, building inspectors, and other local and regional government officials have taken notice and are now increasingly strict and requiring that steps be taken to alleviate air pressure build up and imbalances in homes and public places, such as restaurants.

One measure that can be taken by homeowners and businesses to meet regulations on maintaining safe pressure is using a make-up air unit. This type of unit can operate in conjunction with ranges, furnaces, gas and electric cooktops, and cooking edifices. Typically, these units have air flow sensors to determine whether to let fresh air into a space (e.g., a home or restaurant kitchen) or to get air that is in the confined space out. For example, 800 cubic feet of air per minute may be exiting a home through a range hood which likely causes a dangerous negative air pressure environment for individuals in the home. There is a need to balance the negative air pressure caused by the exiting air. Naturally, this is best done by bringing fresh air into the space, thereby balancing the air pressure. Bringing air in or letting air out is the primary function of a make-up air unit.

Conventional make-up air units are not generally portable or self-contained. There are typically wires that run from a flow sensor within a tube that sends a signal to a remote system to open a pipe in order to bring air in or let air out. As such, installation of conventional make-up air units can be cumbersome and expensive. In addition, they are not easily configurable to meet the needs of different types of ranges, furnaces, gas and electric cooktops, and cooking edifices. Sometimes, conventional make-up air units have to be installed in common use areas, such as windows, or on a wall in plain sight, which can cumbersome to install or may not be aesthetically pleasing to look at. There remains a need for improvements to make-up air units.

SUMMARY

A makeup air unit, comprising a housing defining a compartment. The housing further defines at least one exhaust inlet for receiving air from an indoor space into the compartment and at least one exhaust outlet for passing air from the compartment to the atmosphere. The housing further defines at least one intake inlet and at least one intake outlet each extending into the compartment. The at least one exhaust inlet and the at least one exhaust outlet are fluidly disconnected from the at least one intake inlet and the at least one intake outlet. An air moving device overlies the intake outlet and is configured to transfer air from the compartment through the at least one intake outlet into the work space. A flow detector is disposed in the compartment adjacent to the at least one exhaust outlet and is configured to detect a flow of air through the at least one exhaust inlet and to activate the air moving device in response to a detection of the flow of air.

According to another aspect of the disclosure, a makeup air unit is provided for maintaining an air pressure in an indoor space comprises a housing having at least one wall and defining a compartment. The at least one wall of the housing defines at least one exhaust inlet for receiving air from the indoor space into the compartment and at least one exhaust outlet for passing the received air from the compartment into an atmosphere. The at least one wall of the housing further defines at least one intake inlet for passing air from the compartment into the indoor space and at least one intake outlet for receiving air from the atmosphere into the compartment. The at least one exhaust inlet and the at least one exhaust outlet are fluidly disconnected from the at least one intake inlet and the at least one intake outlet. A fan overlies the at least one intake inlet in the compartment and is configured to transfer air from the compartment through the at least one intake inlet into the indoor space. A flap switch unit is disposed in the compartment and is configured to detect a flow of air through the at least one exhaust inlet and to activate the fan in response to a detection of a flow of air through the at least one exhaust inlet in order to replenish air in the indoor space after air has passed out of the indoor space through the at least one exhaust inlet in order to maintain air pressure in the indoor space at a predetermined level. A power cable is electrically connected to the fan and the flap switch unit. The power cable extends from inside the compartment to outside of the housing. No other cables extend from inside the compartment to outside of the housing.

Accordingly, the subject make-up air unit is self-contained, and thus can be configured to have no running wires/cables outside the housing other than a power cable. This allows the make-up air unit to be portable and easily configurable. Furthermore, the self-sensing flow detector which activates the fan enables the make-up air unit to be self-operating. Additionally, the simple and compact arrangement of the make-up air unit allows it to be installed in a variety of HVAC systems, thus making it universal.

DRAWINGS

Other advantages of the present invention will be readily appreciated, as the same becomes better understood by reference to the following detailed description when considered in connection with the accompanying drawings wherein.

DETAILED DESCRIPTION

Figure 1:
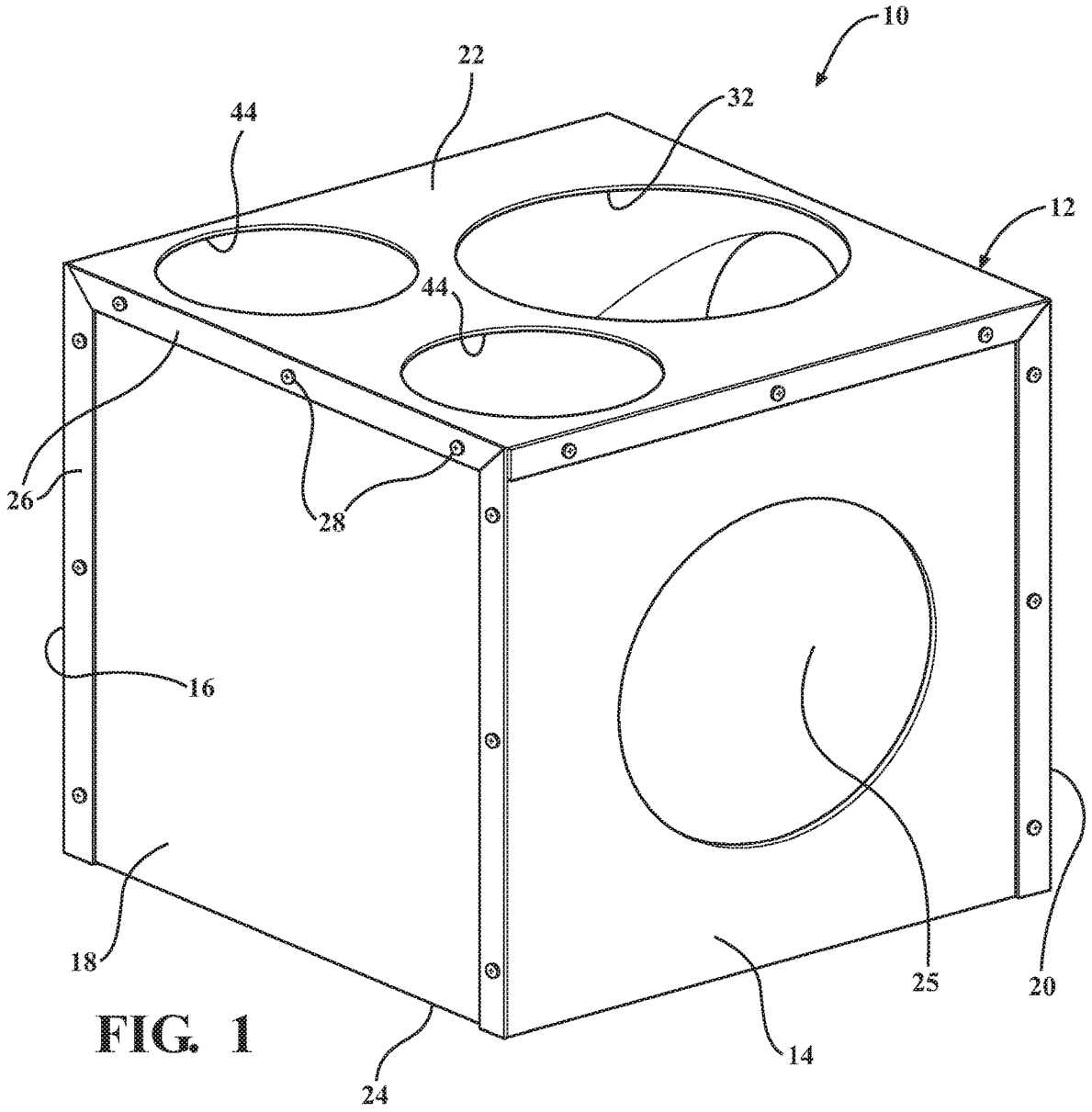
FIG. 1 is a perspective view of an example embodiment of a make-up air unit.

Exemplary embodiments will now be described more fully with reference to the accompanying drawings. In particular, embodiments of a make-up air unit are provided so that this disclosure will be thorough and will fully convey the true and intended scope to those who are skilled in the art. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. It should be appreciated that the subject make-up air unit may be used in conjunction with various indoor spaces, such as a hood for a kitchen range or welding station.

With Referring to the figures, wherein like numerals indicate corresponding parts throughout the several views, a makeup air unit 10 is generally shown. The primary function of a make-up air unit 10 is to balance air pressure in a contained indoor space 11, e.g., close to or completely air tight (generally shown in FIG. 3). The makeup air unit 10 includes a housing 12. According to the example embodiment, the housing 12 has a cuboid shape and includes a front wall 14, a rear wall 16, a left wall 18, a right wall 20, a top wall 22 and a bottom wall 24 arranged in a cuboid shape and defining a compartment 25. Each of the walls 14-24 are between 10 and 11 inches in both height and width. The housing 12 could have other shapes and sizes. A plurality of flanges 26 are located along edges of the walls 14-24 for aligning the walls 14-24 relative to one another. A plurality of fasteners 28, such as screws or rivets secure the flanges 26 to the walls 14-24 for securing the walls 14-24 to one another.

Figure 2:
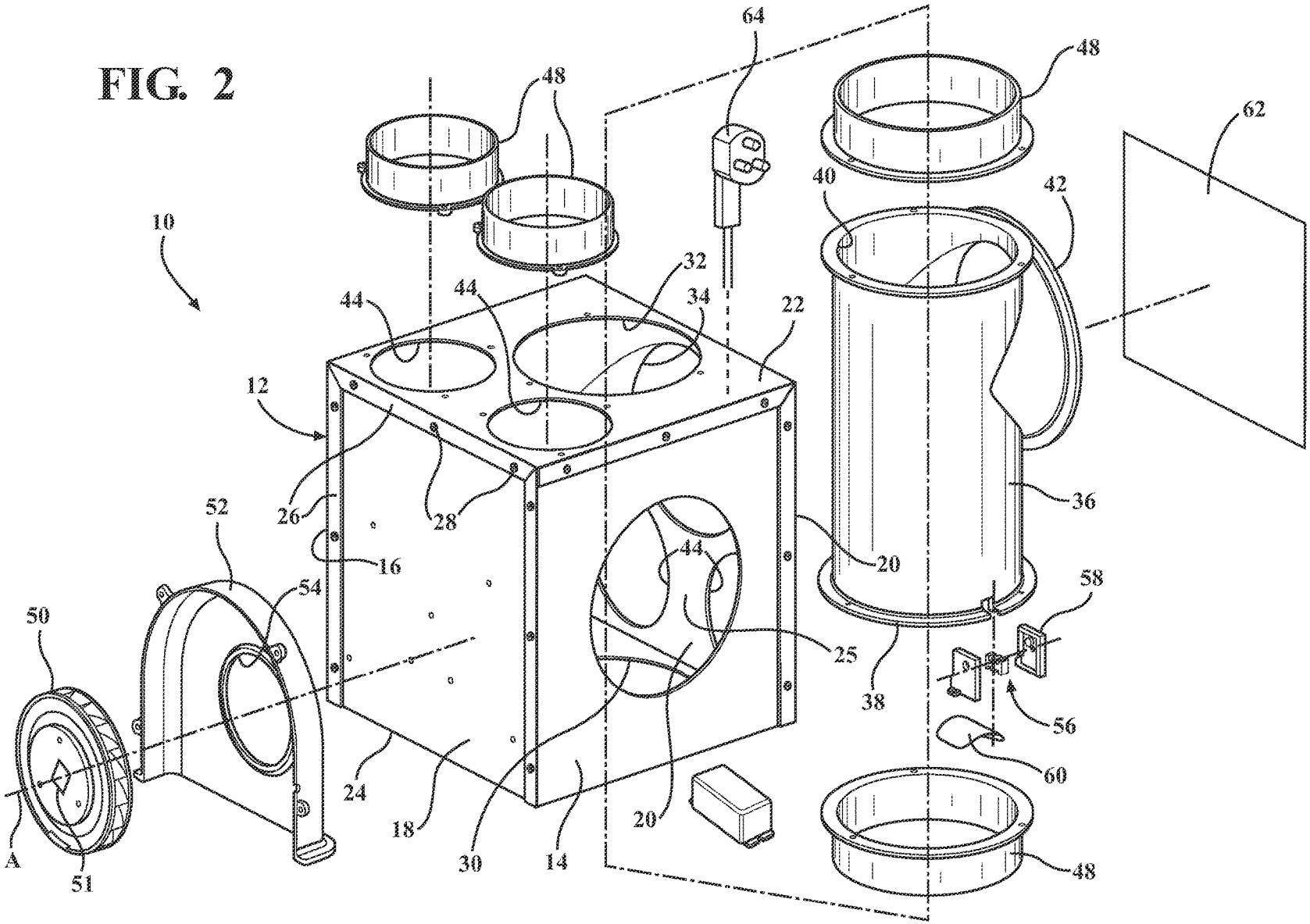
FIG. 2 is an exploded, perspective view of the example embodiment of a make-up air unit.
Figure 3:
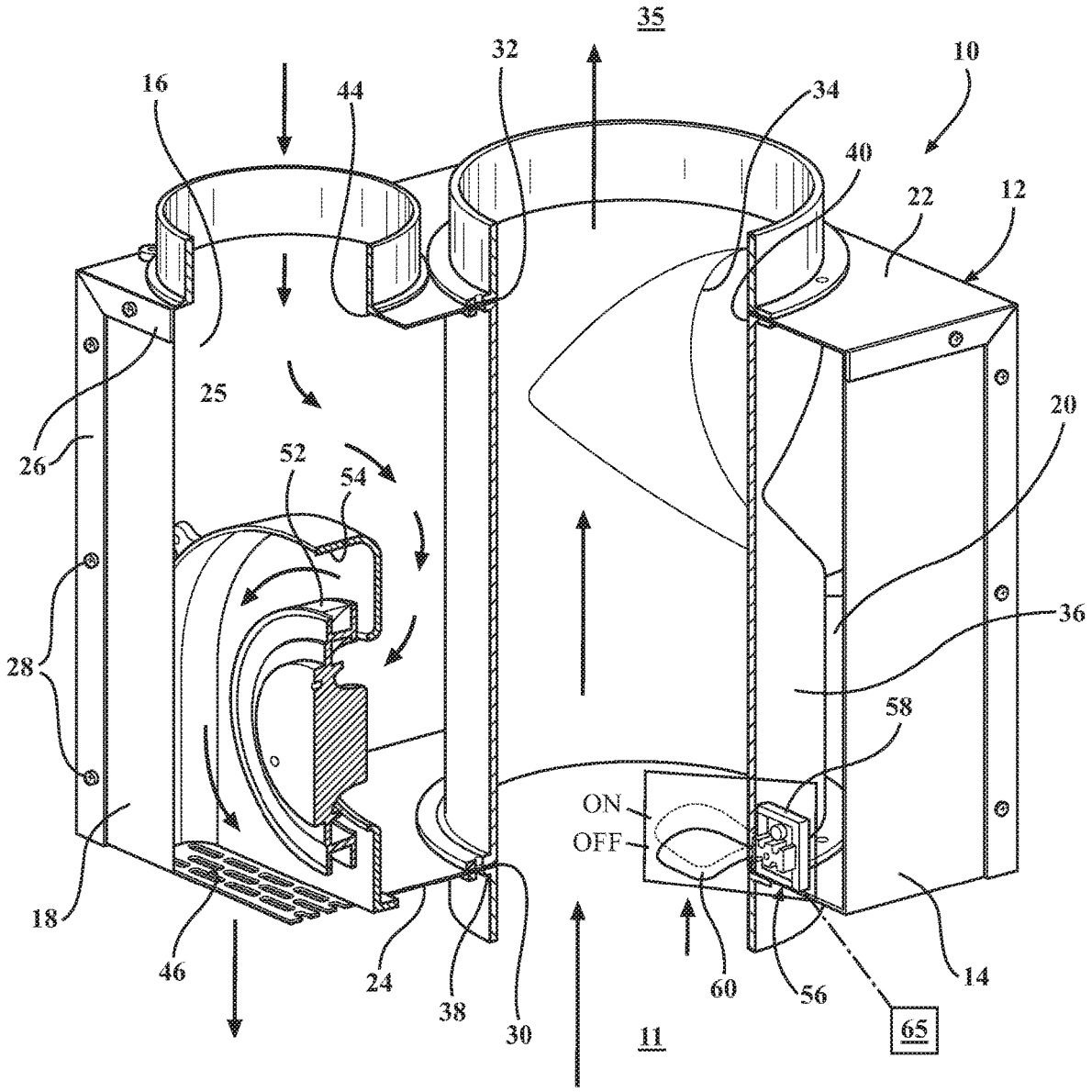
FIG. 3 is a perspective, cutaway view of the example embodiment of a make-up air unit.

As best shown in FIGS. 2-3, the bottom wall 24 defines an exhaust inlet 30 for receiving air from the indoor space 11 into the compartment 25 of the housing 12. The top wall 22 defines a first exhaust outlet 32 and the right wall 20 defines a second exhaust outlet 34 for passing the received air from the compartment 25 into an atmosphere 35 (generally shown in FIG. 3) outside of the housing 12. An exhaust pipe 36 is located in the compartment 25 and extends between the exhaust inlet 30 and the first and second exhaust outlets 32, 34 in the compartment 25 for directing air that is received from the indoor space 11 to the first and second exhaust outlets 32, 34. The exhaust pipe 36 generally has a T-shape with a bottom mouth 38 located in the exhaust inlet 30, a top mouth 40 located in the first exhaust outlet 32 and a side mouth 42 located in the second exhaust outlet 34. It should be appreciated that more exhaust inlets 30, and more or fewer exhaust outlets 32, 34 could be employed.

The top wall 22 of the housing 12 further defines two intake inlets 44 for receiving air from the atmosphere 35 into the compartment 25. The right wall 20 of the housing 12 also defines two intake inlets 44 for receiving air from the atmosphere 35 into the compartment 25. The bottom wall 24 of the housing 12 defines an intake outlet 46 for passing air from the compartment 12 into the indoor space 11. According to the example embodiment, the intake outlet 46 is comprised of an array of small orifices. It should be appreciated that more or fewer intake outlets 46, and more or fewer intake inlets 44 could be employed and they could be at other locations of the housing 12.

The exhaust inlet 30 and first and second exhaust outlet 32, 34 are fluidly disconnected from the intake inlet and outlet 44, 46 by way of the exhaust pipe 36. It should be appreciated that the exhaust inlet 30 and first and second exhaust outlets 32, 34 could be fluidly disconnected from the intake inlet and outlet 44, 46 in other ways, e.g., a divider could sealingly extend between walls of the housing 12, thus isolating the exhaust inlet 30 and first and second exhaust outlets 32, 34 from one another.

A plurality of adapters 48 are each coupled with the exhaust inlet 30, the first and second exhaust outlets 32, 34 and the intake inlets 44 outside of the compartment 25 to allow the exhaust inlet 30, the first and second exhaust outlets 32, 34 and the intake inlets 44 to be secured to other connecting devices, e.g., pipes. The adapters 48 may have various sizes and shapes depending on specific needs. Any number of adapters 48 could be employed as needed.

An air moving device, such as a fan 50, is located in the compartment 25 and overlies the intake outlet 46 and is rotatable about an axis A. The fan 50 is configured to transfer air from the compartment 25 through the intake outlet 46 into the indoor space 11 in order to replenish air in the indoor space 11. The fan 50 includes a motor (schematically shown) 51 for providing rotational movement of the fan 50 about the axis A. A shroud 52 is disposed in the compartment 25 about the fan 50, with the fan 50 being rotatably mounted within the shroud 52. The shroud 52 is fastened to the bottom wall 24 and the left wall 18. The shroud 52 defines an opening 54 for allowing air to pass from the compartment 25 into the shroud 52. The shroud 52 overlies the intake outlet 46 such that rotation of the fan 50 causes air to pass from the compartment through the intake outlet 46, into the indoor space 11. More particularly, the fan 50 is configured to axially draw air into the compartment 25 of the shroud 52 and to transfer the air radially through the intake outlet 46.

A flow detector 56 is disposed in the compartment 25 and configured to detect a flow of air through the exhaust inlet 30, and to activate the fan 50 in response to a detection of a flow of air through the exhaust inlet 30 in order to replenish air in the indoor space 11. More particularly, according to the example embodiment, the flow detector 56 is a flap switch unit 56 that includes a container 58 located in the compartment 25 outside of the exhaust pipe 36 and a flap 60 located inside the exhaust pipe 36 and pivotably connected to the container 58. The flap 60 can be switched into ON or OFF positions depending on a direction of air flow through the exhaust pipe 36 for activating and deactivating the fan 50. The flap 60 is configured to be biased toward the OFF position, but could alternatively be biased in the ON position. More particularly, when air passes from the indoor space 11 into the exhaust pipe 60, the flap 60 flips up into the ON position and activates the fan 50. On the other hand, when air passes from the atmosphere 35 into the exhaust pipe 36, or when there is no airflow through the exhaust pipe 36, the flap 60 is biased toward the OFF position, which deactivates the fan 50. This allows an air pressure in the indoor space 11 to remain at a predetermined level. Depending on the direction or orientation of the exhaust pipe 36, whether it is horizontal or vertical, a plate 62 (shown in FIG. 2) may cover the first or second exhaust outlets 32, 34 on the top or right walls 22, 20, in order to allow air to flow through one of the exhaust outlets 32, 34 more efficiently and at a higher velocity. One or more plates 62 may be located over one or more intake inlets 44 for blocking the same, as needed. This provides easy adaptability of the make-up air unit 10 depending on its specific arrangement.

FIG. 3 is a cut-away diagram of the make-up air unit 100, showing an example of air flow in accordance with an embodiment. As represented by arrows extending through the exhaust outlet 30, in this example, air flows from inside the indoor space 11, though the exhaust inlet 30 and through the first exhaust outlet 32 through the exhaust pipe 36 and to one or more of the first and second exhaust outlets 32, 34. This may be caused, for example, in the event that the indoor space 11 is a kitchen including a range hood, and the range hood is activated. This upward air flow triggers the flap 60 to move from the OFF position to the ON position (indicated by the dashed outline of the flap 60). In response to the flap switching from the OFF position to the ON position, the fan 50 is activated, causing air to be sucked into the compartment 25 from the atmosphere 25 through the intake inlet 44 and into the indoor space 11, as demonstrated by the smaller arrows pointing down and circulating through the fan 50. Through this means, fresh air is introduced into the indoor space 11, thereby maintaining a desired air pressure therein.

Figure 4:
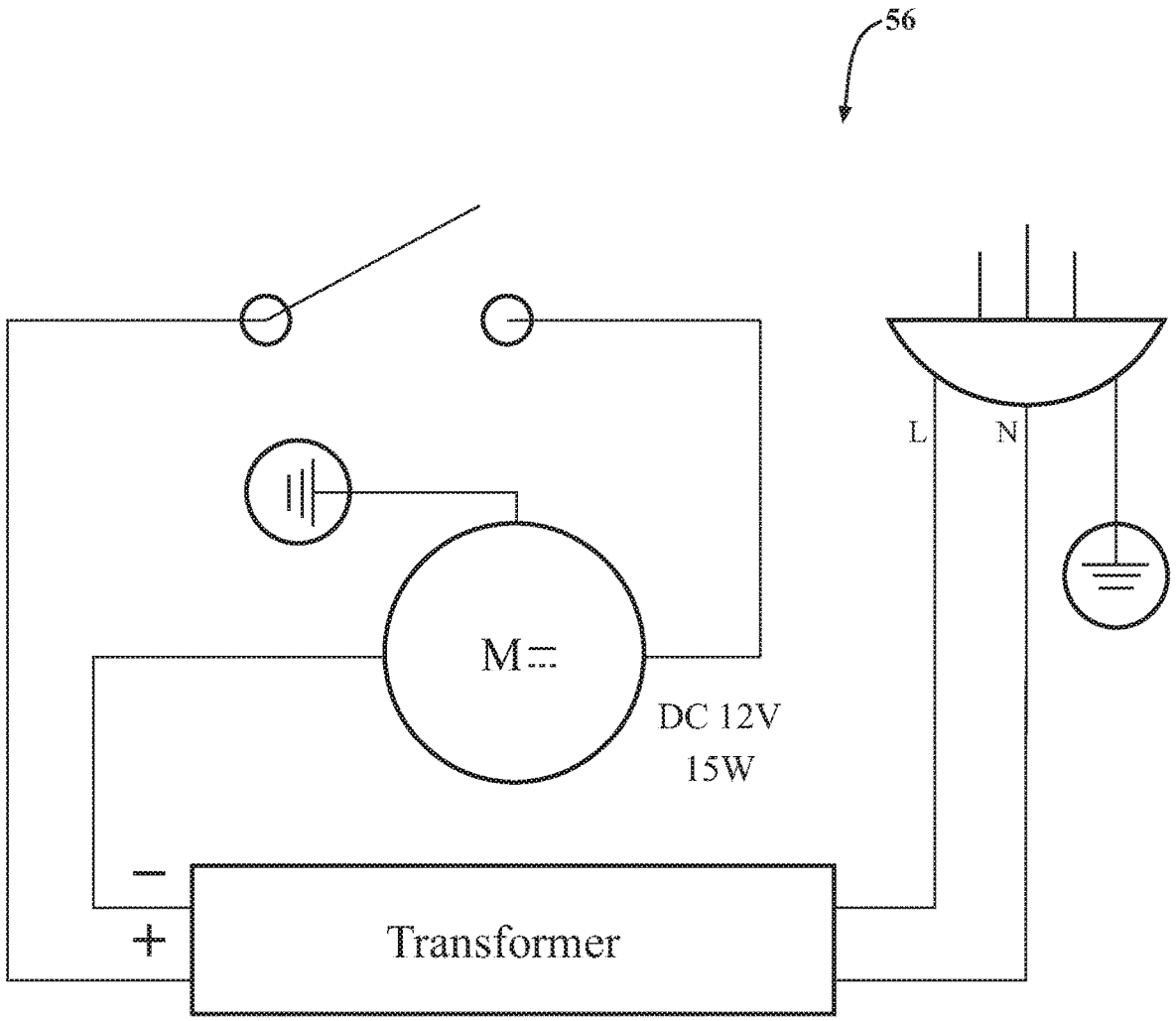
FIG. 4 is a circuit diagram of an example embodiment of a flap switch unit of the example embodiment of a make-up air unit.

FIG. 4 is a circuit diagram 56 of the flap switch unit in accordance with one embodiment of the invention. The circuit is shown as open when the flap 60 is in the OFF (lowered) position. The circuit closes when the flap 60 is blown upward to the ON position. When the circuit is closed, power is supplied to operate the fan 50.

All wiring connected between the flap switch unit 56 and the motor 51 of the fan 50 are in the compartment 25. The only cable/wire that exits the compartment is a power cable 64 for being plugged into a power source and electrically coupled with the flap switch unit 56 and motor 51 for powering the same. As such, when the make-up air unit 10 is installed or moved, no re-wiring or other electrical work needs to be done, other than unplugging the power cable 64 from the power source. The make-up air unit 10 could alternatively have a self-contained power source such as a battery 65 (schematically shown in FIG. 3).

Because of the compact and simple arrangement, and symmetrical shape of the make-up air unit 10, it can be configured vertically or directly into, for example, a back wall or into a rafter or floor joint. Furthermore, the make-up air unit 10 can be arranged in any direction. The intake inlets and outlets 44, 46 and exhaust inlet and outlets 30-34 may be arranged on other walls in order to allow the make-up air unit 10 to be positioned in various directions. As such, the make-up air unit 10 can also be installed in a variety of HVAC systems, making it a universal make-up air unit 10.

Furthermore, the make-up air unit 10 is a self-contained unit which has no running wires outside the unit other than the power cable 64 which enables the make-up air unit 10 to have its own dedicated power source. This is tied to another advantage of the unit 10, namely, that it is portable and easily configurable. Furthermore, the self-sensing flap 60 which turns the fan ON or OFF enables the unit to be self-operating.

Obviously, many modifications and variations of the present invention are possible in light of the above teachings and may be practiced otherwise than as specifically described while within the scope of the appended claims. Individual elements or features of a particular embodiment are generally not limited to that particular embodiment, but, where applicable, are interchangeable and can be used in a selected embodiment, even if not specifically shown or described.

What is claimed is:

1. A makeup air unit for balancing air pressure in an indoor space, comprising:

a housing defining a compartment;

the housing further defining at least one exhaust inlet for receiving air from an external source in the indoor space into the compartment and at least one exhaust outlet for expelling air out of the compartment to an atmosphere outside of the indoor space;

the housing further defining at least one intake inlet for receiving ambient air from the atmosphere into the compartment and at least one intake outlet for passing air from the compartment to the indoor space;

an exhaust pipe located in the compartment and extending between the at least one exhaust inlet and the at least one exhaust outlet and fluidly disconnecting the at least one exhaust inlet and the at least one exhaust outlet from the at least one intake inlet and the at least one intake outlet;

a fan overlying the at least one intake outlet and configured to transfer air from the compartment through the at least one intake outlet; and a flow detector disposed in the compartment adjacent to the at least one exhaust inlet and configured to detect a flow of air through the at least one exhaust inlet and to activate the fan in response to a detection of a flow of air;

wherein the flow detector is a flap switch unit including a container located in the compartment outside of the exhaust pipe and a flap located inside the exhaust pipe.

2. The makeup air unit as set forth in claim 1 wherein the housing has a cuboid shape.

3. The makeup air unit as set forth in claim 2, wherein the housing has a front wall, a rear wall, a left wall, a right wall, a top wall and a bottom wall, and wherein the at least one exhaust inlet and the at least one intake outlet are defined by the bottom wall.

4. The makeup air unit as set forth in claim 2, wherein the at least one exhaust outlet and the at least one intake inlet are defined by the top wall, and wherein the at least one exhaust inlet and the at least one intake outlet are defined by the bottom wall.

5. The makeup air unit as set forth in claim 1 further including at least one adapter overlying at least one of the at least one exhaust inlet, the at least one exhaust outlet, the at least one intake inlet and the at least one intake outlet, and wherein the at least one adapter is for allowing the least one exhaust inlet, the at least one exhaust outlet, the at least one intake inlet and the at least one intake outlet to be connected to external pipes.

6. The makeup air unit as set forth in claim 1 wherein the at least one exhaust outlet includes a pair of exhaust outlets being spaced from one another.

7. The makeup air unit as set forth in claim 6 wherein the at least one exhaust outlet includes a pair of exhaust outlets being spaced from one another.

8. The makeup air unit as set forth in claim 1 wherein a shroud is disposed in the compartment and overlies the intake outlet, and wherein the fan is rotatably disposed in the shroud.

9. A makeup air unit for balancing air pressure in an indoor space, comprising:

a housing defining a compartment;

the housing further defining at least one exhaust inlet for receiving air from an external source in the indoor space into the compartment and at least one exhaust outlet for expelling air out of the compartment to an atmosphere outside of the indoor space;

the housing further defining at least one intake inlet for receiving ambient air from the atmosphere into the compartment and at least one intake outlet for passing air from the compartment to the indoor space;

the at least one exhaust inlet and the at least one exhaust outlet being fluidly disconnected from the at least one intake inlet and the at least one intake outlet;

a fan overlying the at least one intake outlet and configured to transfer air from the compartment through the at least one intake outlet; and an air flow sensor disposed in the compartment adjacent to the at least one exhaust inlet and configured to detect a flow of air through the at least one exhaust inlet and to activate the fan in response to a detection of a flow of air;

wherein a power cable is electrically connected to the fan and the air flow sensor for powering the fan and the air flow sensor, wherein the power cable extends from inside the compartment to outside of the housing, and wherein no other cables extend from inside the compartment to outside of the housing.

10. A makeup air unit for maintaining an air pressure in an indoor space, comprising:

a housing having at least one wall and defining a compartment;

the at least one wall of the housing defining at least one exhaust inlet for receiving air from an external source in the indoor space into the compartment and at least one exhaust outlet for passing the received air from the compartment into an atmosphere outside of the indoor space;

the at least one wall of the housing further defining at least one intake inlet for receiving ambient air from the atmosphere into the compartment, and at least one intake outlet for passing air from the compartment to the indoor space;

the at least one exhaust inlet and the at least one exhaust outlet being fluidly disconnected from the at least one intake inlet and the at least one intake outlet;

a fan overlying the at least one intake outlet in the compartment and configured to transfer air from the compartment through the at least one intake outlet into the indoor space;

a flap switch unit disposed in the compartment and configured to detect a flow of air through the at least one exhaust inlet and to activate the fan in response to a detection of a flow of air through the at least one exhaust inlet in order to replenish air in the indoor space after air has passed out of the indoor space through the at least one exhaust inlet in order to maintain air pressure in the indoor space at a predetermined level;

a power cable electrically connected to the fan and the flap switch unit for powering the fan and the flap switch unit, the power cable extending from inside the compartment to outside of the housing, and wherein no other cables extend from inside the compartment to outside of the housing.

11. The makeup air unit as set forth in claim 10 wherein the housing has a cuboid shape.

12. The makeup air unit as set forth in claim 11, wherein the housing has a front wall, a rear wall, a left wall, a right wall, a top wall and a bottom wall, and wherein the at least one exhaust inlet and the at least one intake outlet are defined by the bottom wall.

13. The makeup air unit as set forth in claim 12, wherein the at least one exhaust outlet and the at least one intake inlet are defined by the top wall and wherein the at least one exhaust inlet and the at least one intake outlet are defined by the bottom wall.

14. The makeup air unit as set forth in claim 13, wherein an exhaust pipe extends between the at least one exhaust inlet and the at least one exhaust outlet in the compartment and fluidly disconnects the at least one exhaust inlet and the at least one exhaust outlet from the at least one intake inlet and the at least one intake outlet.

15. The makeup air unit as set forth in claim 10 further including at least one adapter overlying at least one of the at least one exhaust inlet, the at least one exhaust outlet, the at least one intake inlet and the at least one intake outlet, and wherein the at least one adapter is for allowing the least one exhaust inlet, the at least one exhaust outlet, the at least one intake inlet and the at least one intake outlet to be connected to external pipes.

16. The makeup air unit as set forth in claim 10 wherein the flap switch unit includes a container located in the compartment outside of the exhaust pipe and a flap located inside the exhaust pipe.

17. The makeup air unit as set forth in claim 10, wherein a shroud is disposed in the compartment and overlies the intake outlet, and wherein the fan is rotatably disposed in the shroud.

* * * * *